United States Patent [19]

Stöbi

[11] 4,236,391

[45] Dec. 2, 1980

[54] STEAMER FOR A CONTINUOUSLY THROUGHPASSING TEXTILE WEB

[75] Inventor: Johann Stöbi, Uzwil, Switzerland

[73] Assignee: Maschinenfabrik Benninger AG, Uzwil, Switzerland

[21] Appl. No.: 115,757

[22] Filed: Jan. 25, 1980

[30] Foreign Application Priority Data

Feb. 6, 1979 [CH] Switzerland ..... 1141/79

[51] Int. Cl.[3] ..... D06B 3/10

[52] U.S. Cl. ..... 68/5 D; 34/159; 226/110; 226/118

[58] Field of Search ..... 68/5 D, 5 E; 34/159, 34/161, 118; 226/109, 110, 118

[56] References Cited

U.S. PATENT DOCUMENTS 2,431,372 11/1947 Cook et al. ..... 68/5 D X

FOREIGN PATENT DOCUMENTS 2655955 6/1978 Fed. Rep. of Germany ..... 68/5 D 977560 12/1964 United Kingdom ..... 68/5 D

*Primary Examiner*—Philip R. Coe

*Attorney, Agent, or Firm*—Werner W. Kleeman

[57] ABSTRACT

Within the housing of a steamer there is arranged below a group of deflection rolls for the substantially zig-zag guiding of a textile web in a spread apart or open width condition a roll bed formed of rolls upon which the web, following its passage through the deflection rolls, is deposited in a folded or plaited condition by means of a rod roll and can be further transported. So that the web can be subjected to a short time treatment, within the same steamer, without using the roll bed, and thus, can be adequately supported in the sense of guiding the web in open width, one roll, even possibly a number of rolls, of the roll bed can be pivoted out of the region of the roll bed in order to assume a second work or operating position which supports the web guided in an open width or spread apart condition through the entire steamer. This pivotable roll is mounted at one end of a lever of a lever pair or lever means which can be pivoted about a shaft from externally of the steamer housing.

8 Claims, 2 Drawing Figures

STEAMER FOR A CONTINUOUSLY THROUGHPASSING TEXTILE WEB

BACKGROUND OF THE INVENTION

The present invention relates to a new and improved construction of a steamer for treatment of a continuously through-passing textile web which, throughout a certain residence time, is exposed to the action of suitable reaction means.

In order to be able to particularly treat cotton fabrics and cotton-wool mixed fabrics so as to achieve a faultless dye absorbtion or to ensure that the pretreatment prior to fabric printing is faultless, it is already known to the art to use a so-called continuous installation wherein a textile web which is to be processed is delivered continuously in a spread apart condition through a steamer and is heated therein during a predetermined residence time and exposed to the action of certain predetermined chemicals. On the one hand, this treatment is intended to promote the removal of husks and, on the other hand, to obtain the desired absorbancy, levelness and whiteness.

The effectiveness of this treatment is dependent upon two factors, namely upon the residence time of the web material which is being treated within the steamer and upon the quantitative amounts of chemicals employed during treatment.

Two different concepts of steamer have been developed by the textile processing industry.

According to a first concept it is intended that the consumption of chemicals be reduced to a minimum in that the residence time of the web within the steamer is as great as possible. In order to maintain the dimensions of such steamer within tolerable limits it has been proposed, for instance as disclosed in the German Patent Publication No. 2,605,292, to guide the continuously infed and outfed web within the confines of the steamer, initially in a wide condition, over deflection rolls and thereafter to convey such web, while plaited in folds, upon a sieve or filter band arranged below the deflection roll-guide arrangement. Upon this sieve band the web is further transported in a piled state in an orderly array of loop layers, so that with small spatial requirements there can be obtained an appreciable increase in the residence time.

However, with certain qualities of the web material the transport of the web through the pretreatment steamer in the form of a tightly pressed together fabric stack or pile causes the formation of crease folds and fold marks.

According to another concept which has been developed, particularly suitable for pronouncedly fold sensitive web qualities, the web is guided in a spread apart or open-width condition throughout its entire path of travel through the steamer, and rows of deflection rolls are arranged such that the web is guided throughout as long as possible travel path within the steamer. Nonetheless within such steamer, if its dimensions are held within tolerable limits, there only can be obtained a residence time which is less by a multiple in comparison to that which is realizable within a steamer of the previously mentioned type, which, in turn, again only can be counteracted by a more intensive employment of the treatment chemicals.

Hence, both systems have certain advantages for predetermined web or cloth qualities, and it is for this reason that processing plants frequently have steamers of both constructional types or designs. Yet, apart from the equipment expenditure associated therewith and the space requirements needed, further drawbacks worthy of mention in this respect are that when changing from one steamer to another steamer each time the web must be newly threaded through the steamer and the subsequent devices of the treatment installation. Also, appreciable energy losses result due to cooling of the installation during the downtimes.

SUMMARY OF THE INVENTION

Therefore, it is a primary object of the present invention to provide a new and improved construction of a steamer for the treatment of a continuously through-passing textile web which is not afflicted with the aforementioned drawbacks and limitations of the prior art constructions discussed above.

Another and more specific object of the present invention aims at providing a new and improved construction of steamer which selectively is capable of carrying out a long time treatment like that performed in a steamer of the first mentioned type, known for instance from the mentioned German Patent Publication No. 2,605,292, by way of example, and equally also a short time treatment corresponding to that which can be realized in a steamer having a roll guide arrangement and furthermore, enables rapid and simple changeover from one operational mode to the other operational mode without there being required for this purpose rethreading of a drawn-in web or cooling down of the steamer for the purpose of carrying out manual operations within the steamer housing.

Yet a further significant object of the present invention is directed to the provision of a new and improved construction of steamer for a textile web which selectively enables performing different treatment modes within the same steamer so as to expand the field of use thereof, and thereby reducing the need for costly equipment expenditure as heretofore required when separate types or designs of steamers had to be procured to carry out each different type of treatment operation.

Yet a further important object of the present invention aims at providing a new and improved construction of pretreatment steamer which is relatively simple in design, possesses an expanded field of use, is economical to manufacture, extremely reliable in operation, not readily subject to breakdown or malfunction, and requires a minimum of maintenance and servicing.

Now in order to implement these and still further objects of the invention, which will become more readily apparent as the description proceeds, the invention contemplates the provision of a steamer for the treatment of a continuously throughpassing textile web or the like and comprises a housing which is closed with the exception of an inlet slot or opening and an outlet slot or opening for the throughpassing web. Within the steamer housing there is arranged a group of deflection rolls for the substantially zig-zag guiding of a web in an open width of spread apart condition. Arranged after the group of deflection rolls, viewed with respect to the direction of travel of the web through the steamer, is a device for guiding and transport of the web which is plaited or otherwise appropriately deposited thereon. The steamer is constructed such that the device for guiding and transporting the plaited web contains at least one guide element, for instance a roll or a rod, which can be positionally adjusted from externally of the steamer housing between a first work position constituting part of the aforementioned guiding and transport device and a second work position arranged above the aforementioned device where such guide element supports the web at a distance from the guiding and transport device.

Apart from the simpler and better handling of such steamer there are also realized the benefits of shorter downtimes of the equipment and a decisive saving in energy.

According to an advantageous construction of the steamer, the aforementioned guiding and transport device is formed by a roll bed, and the guide element in its first work position functions as a roll bed-roll, whereas in its second work position this guide element is pivoted out of the confines of the roll bed into a location above the same and at that location supports the open width web which travels above the roll bed.

BRIEF DESCRIPTION OF THE DRAWINGS

The invention will be better understood and objects other than those set forth above, will become apparent when consideration is given to the following detailed description thereof. Such description makes reference to the annexed drawings wherein.

Figure 1:
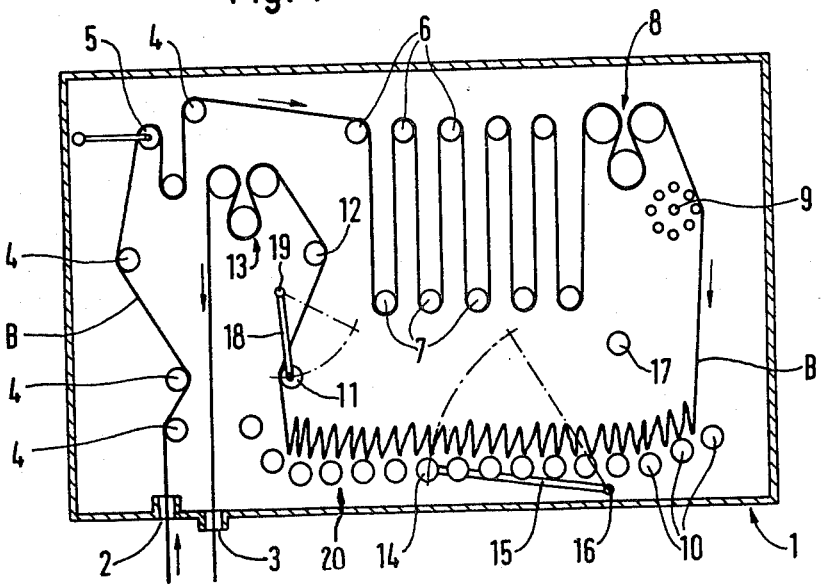
FIG. 1 is a vertical sectional view of a steamer constructed according to the invention showing deposition of the textile web in a folded or plaited condition and structured for performing a longer treatment time upon the web.

DETAILED DESCRIPTION OF THE PREFERRED EMBODIMENTS:

Describing now the drawings, the treatment steamer of the present development illustrated by way of example therein will be seen to comprise a housing 1 which, in conventional manner, is constructed as an essentially closed housing with the exception of an inlet slot or opening 2 for the entry of a web or fabric B which is to be treated and an outlet opening or slot 3 for the exit of the treated web B.

The web B which enters in an open width or spread apart condition through the entry or inlet slot 2 into the interior of the steamer is supported by a number of guide rolls 4, is guided over a pendulum roll 5 which in conventional fashion and therefore not here further shown, particularly since details thereof are not important for understanding the underlying principles of the invention, regulates the drive of the driven rolls. Following the pendulum roll 5 the web B is guided over further guide rolls 4 and infed to a group of deflection rolls 6, 7, composed of upper deflection rolls 6 and lower deflection rolls 7. The number of deflection rolls 6 and 7 is chosen, as a function of the transport velocity of the web B through the steamer, such that during operation each lengthwise section or unit length of the web requires for its passage through the deflection roll group 6, 7 about one to two minutes. With increased cloth travel speeds it is also possible, for the purpose of reducing the external dimensions of the steamer, to provide a cloth course having double loops, equally as is known in this art.

Following the deflection roll group 6, 7, the web B passes through a twist-tension mechanism 8 composed of a bank of not particularly referenced rolls and thereafter is guided over a so-called rod roll 9. By means of the rod roll 9 the web B, in a manner apparent from the showing of FIG. 1, is deposited in folds or pleats upon a guide and transport device 20 which further transports the thus deposited web in this plaited configuration.

The aforementioned device 20 is arranged below the group of deflection rolls 6, 7 within the steamer housing 1. This device 20 is constituted by a roll bed composed of a row of support rolls 10 arranged adjacent one another and with essentially parallel axes, and wherein a number or all of these support rolls 10 can be driven, as desired. The length and transport velocity imparted by the roll bed to the web B deposited thereon in a folded state are dimensioned such, that during operation, each unit length of the web B, from the start to the end of the roll bed, requires a travel time of about five to six minutes.

At the end of the roll bed formed by the support rolls 10 the web B arrives by means of a guide roll 11 and a further guide roll 12 at a second twist-tension mechanism 13, likewise composed of a bank of rolls, and from that location then moves out of the steamer through the outlet or exit slot 3.

The guiding of the textile web B through the steamer as shown in FIG. 1 and described above, therefore results in a reaction time of about seven minutes for each unit length of the web B, which corresponds to approximately the reaction time obtained when working with a steamer constructed according to the previously mentioned German Patent Publication No. 2,605,292.

In this respect there is considered as part of the reaction time the residence time at the group of deflection rolls 6, 7 which at the same time constitutes the heating zone of the steamer.

In contrast to the heretofore known steamers of such species it is, however, possible with the described and illustrated steamer to convert the equipment, with very few manual operations or manipulations carried out from externally of the housing, into a steamer which is suitable for the treatment of web qualities at the treatment installation which only require a reaction time of about one to two minutes and/or for which transport of the web in a folded condition, as shown in FIG. 1 upon the roll bed, constitutes a risk in terms of the quality of the treated cloth.

What is worthy of mention is that this conversion of the steamer can be accomplished without there being required that the cloth web be "rethreaded" within the steamer, and hence, also without it being necessary to wait for the steamer to cool down in order to accomplish the rethreading operation and thereafter again having to wait until reaching the operating temperature of the equipment. Apart from the appreciable reduction in the downtime of the steamer these advantages also result in a considerable saving in energy.

Figure 2:
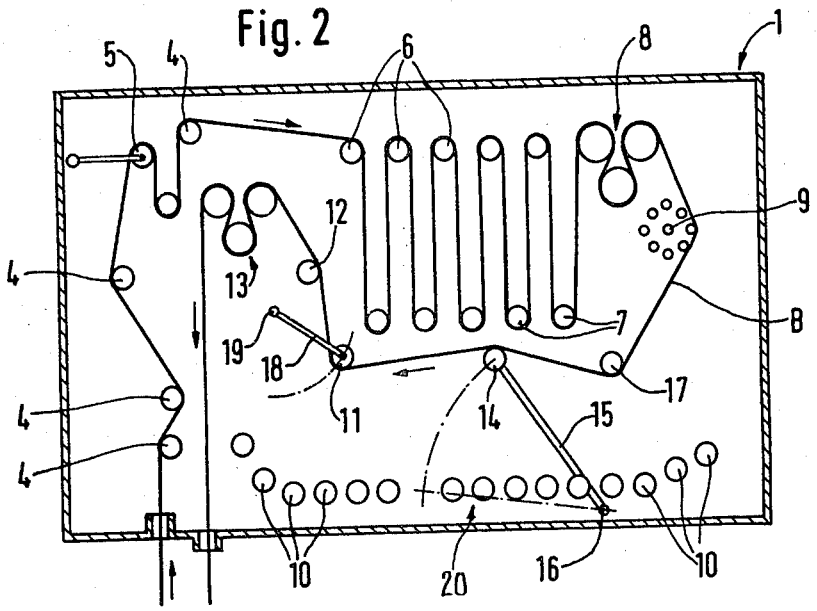
FIG. 2 is a vertical sectional view, corresponding to the showing of FIG. 1 of the same steamer, showing the equipment in an operating state where the web is not deposited, and the equipment is structured for carrying out a shorter treatment time.

In order to accomplish this equipment conversion and to be able to operate the same steamer as a short time treatment steamer in the manner illustrated in FIG. 2, the device 20 for the transport of the plaited web B of FIG. 1 contains at least one guide element which can be moved from its first work position out of the device 20 in the direction of the group of deflection rolls 6, 7 into a second work position.

With the illustrated steamer one of the rolls 14 —which as will be explained later also may be a rod—of the support rolls 10 forming the roll bed is mounted at the end of a lever arrangement 15, for instance constituted by a pair of pivotal levers. Both of the levers of the lever pair 15, wherein only one is visible in the showing of the drawing, are attached at their othwer end at a pivot shaft 16 which is rotatably mounted in the housing 1 and can be conveniently rocked or pivoted from externally of the housing, for instance manually with the aid of a handwheel or powered by a suitable drive motor between two end or work positions. In the one end or work position the pivotable roll 14 is located in the position shown in FIG. 1 and constitutes part of the roll bed. In the other end or work position the roll 14 assumes the position shown in FIG. 2, where it is rocked or pivoted out of the roll bed.

In this second operating position of the roll 14 the web B now, after its departure from the rod roll 9, can be guided about an additional guide roll 17, which is not effective when the steamer is in its operating mode shown in FIG. 1 as a long time treatment steamer, and furthermore such web is guided about the guide roll 11 directly to the guide roll 12 and the tension mechanism 13. The upwardly rocked or pivoted roll 14 assumes the requisite supporting action for the web B between the guide rolls 17 and 11.

In this regard, and as also seen by referring to FIG. 2, the guide roll 11 is also advantageously mounted at levers or lever means 18 and arranged to be pivotable about a pivot shaft 19. The web B which is guided in the position of the components shown in FIG. 2 through the steamer, which now functions as a short time treatment steamer, is therefore guided along the shortest path following the group of deflection rolls 6, 7 out of the steamer. The reaction time amounts to about one to two minutes during which the web is continuously guided in a wide or open width condition.

If both of the pivotably mounted rolls 14 and 11 are again rocked back into their positions as shown in FIG. 1, then the steamer is again operationally ready for a long time treatment operation with plaiting of the web upon the roll bed, without there being required opening of the steamer housing 1 to carry out any manipulations or manual operations and without there being needed any new drawing-in or threading-in of the web.

The described steamer therefore can be equally well employed both as a short time treatment steamer, without using the roll bed, for fold sensitive cloths or fabrics, and also as a long time treatment steamer with deposition of the web upon the roll bed for longer reaction times. It is therefore possible to solve the problem of optimum mode of operation for the pretreatment of different web qualities and especially the problem of fold markings or creasing of the cloth can be solved for all fabric qualities, in that markedly fold or crease prone cloths can be transported in a full spread apart or open width condition through the steamer according to the showing of FIG. 2, whereas other types of cloth can be deposited in a loose stack and can be treated without tensionally loading the same.

Depending upon the length of the group of deflection rolls 6, 7, which is dependent upon the transpoort velocity of the web and the desired duration of the residence time of the web in such deflection roll group, it can be advantageous to provide instead of only one pivotable roll 14 two or more rolls of the roller bed which can be rocked or pivoted out of the roll bed, in order to obtain adequate support of the web between the rolls 17 and 11 when employing the steamer as a short time treatment steamer according to the showing of FIG. 2.

According to a further not particularly illustrated variant construction the device 20 for the support and transport of the plaited web, instead of being constructed as illustrated from a roll bed composed of a number of suport rolls 10, can be designed so as to contain transport belts or bands, especially sieve belts or bands, wherein the pivotable roll 14 or pivotable rolls, as the case may be, are arranged in each instance between two such transport bands or belts.

In many instances it will be advantageous to also drive the pivotable roll 14 or all of the pivotable rolls of the device for the transport of the folded web, in order to avoid any damming-up of the cloth web.

On the other hand, there are also conceivable fields of application wherein it will be sufficient or advantageous to provide as the guide element a rod or the like, for instance a wiper rod, instead of the pivotable driven and/or non-driven rolls. Hence, conceptually the element 14 can be construed as a wiper rod.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A steamer for treating a continuously through-passing textile web, comprising:

a substantially closed housing having an inlet means and an outlet means for the web and through which travels the web undergoing treatment;

a group of deflection rolls arranged within the housing for the substantially zig-zag guiding of the web in an open width condition through the housing in a predetermined direction of travel;

means for guiding and transport of the web deposited thereon in a plaited condition arranged after the deflection rolls in the direction of travel of the web through the housing;

said means for guiding and transport of the web comprising at least one guide element;

means for moving the guide element from externally of the steamer housing between a first work position and a second work position;

said guide element in its first work position constituting part of the means for guiding and transport of the web; and said guide element in its second work position being arranged above said means for the transport and guiding of the web and supporting the web in spaced relationship from the guiding and transport means.

2. The steamer as defined in claim 1, wherein:

said guide element comprises a roll.

3. The steamer as defined in claim 1, wherein:

said guide element comprises a rod.

4. The steamer as defined in claim 1, wherein:

said guiding and transport means comprises a roll bed; and said guide roll constituting a roll of said roll bed and in said first work position functioning as a roller bed-roll and in said second work position being disposed externally of the roll bed in a position located above the roll bed.

5. The steamer as defined in claim 4, wherein:

a number of rolls of the roll bed are movable out of the roll bed.

6. The steamer as defined in claim 1, wherein:

said moving means for the guide element comprises lever means pivotably mounted at the steamer housing and pivotable from a location externally of the steamer housing;

said lever means having a free end; and said guide element being mounted at the free end of the lever means.

7. The steamer as defined in claim 1, further including:

at least one further guide element; and means for moving said at least one further guide element selectively between two work positions.

8. The steamer as defined in claim 1, wherein:

said guide element comprises wiper rod means.

* * * * *